US007545332B2

(12) United States Patent
Kim et al.

(10) Patent No.: US 7,545,332 B2
(45) Date of Patent: Jun. 9, 2009

(54) ANTENNA AND PORTABLE TERMINAL HAVING THE SAME

(75) Inventors: Mun-Gyu Kim, Gyeonggi-Do (KR); Jong-Hyun Park, Seoul (KR)

(73) Assignee: LG Electronics Inc., Seoul (KR)

( * ) Notice: Subject to any disclaimer, the term of this patent is extended or adjusted under 35 U.S.C. 154(b) by 111 days.

(21) Appl. No.: 11/737,645

(22) Filed: Apr. 19, 2007

(65) Prior Publication Data

US 2007/0247376 A1 Oct. 25, 2007

(30) Foreign Application Priority Data

Apr. 21, 2006 (KR) ..... 10-2006-0036433

(51) Int. Cl.
*H01Q 1/24* (2006.01)

(52) U.S. Cl. ..... 343/702; 343/900; 343/901

(58) Field of Classification Search ..... 343/702, 343/900, 901
See application file for complete search history.

(56) References Cited

U.S. PATENT DOCUMENTS

| | | | | |
|---|---|---|---|---|
| 3,579,241 | A * | 5/1971 | Antista et al. | 343/702 |
| 4,136,344 | A * | 1/1979 | Nakao et al. | 343/702 |
| 5,479,178 | A | 12/1995 | Ha | |
| 5,644,320 | A * | 7/1997 | Rossi | 343/702 |
| 6,195,050 | B1 * | 2/2001 | Kim | 343/700 MS |
| 6,201,503 | B1 | 3/2001 | Oshiyama | |
| 6,208,301 | B1 | 3/2001 | Sandgren et al. | |
| 6,573,868 | B2 * | 6/2003 | Johnson et al. | 343/702 |
| 6,812,897 | B2 * | 11/2004 | Jarmuszewski et al. | 343/702 |
| 7,133,000 | B2 * | 11/2006 | Garcia et al. | 343/901 |

FOREIGN PATENT DOCUMENTS

| | | | |
|---|---|---|---|
| AT | 221590 | B | 6/1962 |
| AT | 221590 | B | 6/1962 |
| AT | 253003 | B | 3/1967 |
| DE | 1441725 | | 10/1969 |
| DE | 7424987 | U | 2/1975 |
| DE | 3343329 | | 6/1985 |
| EP | 0 764 998 | A1 | 3/1997 |
| EP | 0 954 054 | A1 | 11/1999 |
| FR | 2332625 | | 6/1977 |
| GB | 619703 | | 3/1949 |
| GB | 829643 | | 3/1960 |
| GB | 896147 | | 5/1962 |
| GB | 962730 | | 7/1964 |
| GB | 1114628 | | 5/1968 |
| JP | 5031317 | U | 4/1993 |
| JP | 05129816 | | 5/1993 |

* cited by examiner

*Primary Examiner*—Hoang V Nguyen
(74) *Attorney, Agent, or Firm*—Lee, Hong, Degerman, Kang & Waimey

(57) ABSTRACT

The present invention relates to a portable terminal including a terminal body and a retractable antenna operatively connected to the terminal body and capable of being retractably housed into and withdrawn out of the terminal body. The retractable antenna includes a base rotatably supported at the terminal body, an antenna rod connected with the base and including at least one telescoping member of extending a length of the antenna rod, and a pivot connection unit connecting the base to the antenna rod and allowing the antenna rod to pivot with respect to the base.

42 Claims, 12 Drawing Sheets

ANTENNA AND PORTABLE TERMINAL HAVING THE SAME

CROSS-REFERENCE TO RELATED APPLICATIONS

Pursuant to 35 U.S.C. § 119(a), this application claims the benefit of earlier filing date and right of priority to Korean Application No. 10-2006-0036433, filed on Apr. 21, 2006, the contents of which are hereby incorporated by reference herein in their entirety.

FIELD OF THE INVENTION

The present invention relates to an antenna, and particularly, to a retractable antenna operatively connected to a terminal body and capable of being retractably housed into and withdrawn out of the terminal body.

BACKGROUND OF THE INVENTION

FIG. 1 is a cross-sectional view showing an antenna of a portable terminal in accordance with the conventional art. The antenna of the portable terminal in accordance with the conventional art includes an antenna bushing (108) fixed to an upper end of a terminal body (102), an antenna rod (106) movably-arranged in the antenna bushing (108), wherein the antenna rod (106) is received in, and extendable in a longitudinal direction of, the terminal body (102), and an antenna head (110) formed at an end of the antenna rod (106). The antenna is extended above an upper end of the terminal body (102) so as to transceive radio frequencies when a user pulls upon the head (110) mounted at the end of the antenna rod (106).

However, the antenna in accordance with the conventional art is short in length. Thus, the antenna cannot satisfy a frequency bandwidth requirement for receiving a digital broadcast service. Further, because the antenna rod is extendable only in the longitudinal direction of the terminal body, when watching a satellite broadcast or a digital broadcast service while the terminal body is arranged in a landscape or horizontal orientation, the position of the antenna cannot be adjusted.

SUMMARY OF THE INVENTION

The present invention is directed to a retractable antenna operatively connected to a terminal body and capable of being retractably housed into and withdrawn out of the terminal body.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention is embodied in a portable terminal comprising a terminal body, and a retractable antenna operatively connected to the terminal body and capable of being retractably housed into and withdrawn out of the terminal body, wherein the retractable antenna comprises a base rotatably supported at the terminal body, an antenna rod connected with the base and including at least one telescoping member for extending a length of the antenna rod, and a pivot connection unit connecting the base to the antenna rod and allowing the antenna rod to pivot with respect to the base.

In one aspect of the invention, the portable terminal further comprises a connection bushing mounted at the terminal body for guiding a linear motion of the retractable antenna and electrically connecting the antenna to the terminal body. Preferably, an outer circumferential surface of the base frictionally engages an inner circumferential surface of the connection bushing to support a rotated position of the antenna rod. Preferably, an elastic member is provided at the inner circumferential surface of the connection bushing to elastically contact the outer circumferential surface of the base. Preferably, the elastic member comprises one or more plate springs. Preferably, the outer circumferential surface of the base comprises a flared shape having a wider diameter towards a lower end thereof.

In another aspect of the invention, the portable terminal further comprises a multi-stop support formed between the base and the connection bushing for supporting a rotated position of the antenna rod. Preferably, the multi-stop support comprises at least one ball elastically supported at an inner circumferential surface of the connection bushing, and a plurality of detent recesses formed at an outer circumferential surface of the base at angular intervals for engagement by the at least one ball.

In a further aspect of the invention, the portable terminal further comprises a head formed at an upper end of an uppermost telescoping member, wherein the head inserts into the terminal body when the retractable antenna is retractably housed into the terminal body. Preferably, a knob is formed at the head, wherein the knob is capable of being grasped and pulled by a user to withdraw the retractable antenna from the terminal body. Preferably, a stopping jaw is formed at the head, wherein the stopping jaw prevents the retractable antenna from being ejected from the terminal body while the retractable antenna is housed within the terminal body. Preferably, a guide tube is formed in the terminal body and extending in a longitudinal direction thereof for linearly guiding the antenna into and out of the terminal body.

In another aspect of the invention, the pivot connection unit comprises a hinge member fixed to a lower end of the antenna rod and rotatably supported by a hinge shaft mounted at the base, and an elastic support installed in the base for elastically supporting the hinge member to maintain a rotated position of the antenna rod. Preferably, the elastic support comprises a linearly movable frictional member arranged within a space formed in the base and contacting a lower end of the hinge member, and an elastic member arranged within the space in the base and providing an elastic urging force to the frictional member. Preferably, the frictional member comprises a rubber material providing a frictional engaging force to the hinge member.

In another aspect of the invention, the pivot connection unit comprises a hinge member fixed to a lower end of the antenna rod and rotatably supported by a hinge pin fixed to the base, and a multi-stop support provided between the base and the hinge member for supporting rotation of the hinge member in multiple stages. Preferably, the multi-stop support comprises a plurality of indentations formed in a circumferential direction at a lower end of the hinge member at regular angular intervals, a ball elastically arranged at the base for engaging the plurality of indentations, and an elastic member for providing an elastic urging force to the ball.

In another aspect of the invention, the pivot connection unit comprises a ball-and-socket type hinge. In a further aspect of the invention, the pivot connection unit comprises a bellows shape.

In accordance with another embodiment of the present invention, a portable terminal having an antenna comprises a terminal body, and a retractable antenna operatively connected to the terminal body and capable of being retractably housed into and withdrawn out of the terminal body, wherein the retractable antenna comprises a base rotatably supported at the terminal body, an antenna rod connected with the base and including at least one telescoping member for extending a length of the antenna rod, and a support provided between the base and the antenna rod for supporting rotation of the antenna rod in an axial direction and enabling the antenna rod to pivot about a pivot axis with respect to the base.

Preferably, the support comprises a ball mounted at a lower end of the antenna rod, and an elastic supporting member mounted in a recess formed in an upper end of the base for elastically supporting rotation of the ball in any direction. Preferably, the elastic supporting member comprises a rubber material including a spherical socket for holding the ball. Alternatively, the elastic supporting member comprises at least one plate spring fixed to the recess and contacting an outer circumferential surface of the ball.

In accordance with another embodiment of the present invention, an antenna for an electronic device comprises a base operatively connected to and rotatably supported at a body of the electronic device, the base capable of being retractably housed into and withdrawn out of the body, an antenna rod connected with the base and including at least one telescoping member for extending a length of the antenna rod, the antenna rod capable of being retractably housed into and withdrawn out of the body, and a pivot connection unit connecting the base to the antenna rod and allowing the antenna rod to pivot with respect to the base.

Preferably, a connection bushing is mounted at the body for guiding a linear motion of the retractable antenna and electrically connecting the antenna to the body. Preferably, an outer circumferential surface of the base frictionally engages an inner circumferential surface of the connection bushing to support a rotated position of the antenna rod. Preferably, an elastic member is provided at the inner circumferential surface of the connection bushing to elastically contact the outer circumferential surface of the base. Preferably, the outer circumferential surface of the base comprises a flared shape having a wider diameter towards a lower end thereof.

In one aspect of the invention, the antenna further comprises a multi-stop support formed between the base and the connection bushing for supporting a rotated position of the antenna rod. Preferably, the multi-stop support comprises at least one ball elastically supported at an inner circumferential surface of the connection bushing, and a plurality of indentations formed at an outer circumferential surface of the base at angular intervals for engagement by the at least one ball.

In another aspect of the invention, the antenna further comprises a head formed at an upper end of an uppermost telescoping member, the head capable of being retractably housed into and withdrawn out of the body, and a stopping jaw formed at the head, wherein the stopping jaw prevents the head from being ejected from the body while the head is housed within the body.

In a further aspect of the invention, the pivot connection unit comprises a hinge member fixed to a lower end of the antenna rod and rotatably supported by a hinge shaft mounted at the base, and an elastic support installed in the base for elastically supporting the hinge member to maintain a rotated position of the antenna rod. Preferably, the elastic support comprises a linearly movable frictional member arranged within a space formed in the base and contacting a lower end of the hinge member, and an elastic member arranged within the space in the base and providing an elastic urging force to the frictional member. Preferably, the frictional member comprises a rubber material providing a frictional engaging force to the hinge member.

In another aspect of the invention, the pivot connection unit comprises a hinge member fixed to a lower end of the antenna rod and rotatably supported by a hinge pin fixed to the base, and a multi-stop support provided between the base and the hinge member for supporting rotation of the hinge member in multiple position stops. Preferably, the multi-stop support comprises a plurality of recesses formed in a circumferential direction at a lower end of the hinge member at angular intervals, a ball elastically arranged at the base for engaging the plurality of recesses, and an elastic member for providing an elastic urging force to the ball.

In another aspect of the invention, the pivot connection unit comprises a ball-and-socket type hinge. In a further aspect of the invention, the pivot connection unit comprises a bellows shape.

In accordance with another embodiment of the present invention, an antenna for an electronic device comprises a base operatively connected to and rotatably supported at a body of the electronic device, the base capable of being retractably housed into and withdrawn out of the body; an antenna rod connected with the base and including at least one telescoping member for extending a length of the antenna rod, the antenna rod capable of being retractably housed into and withdrawn out of the body; and a support provided between the base and the antenna rod for supporting rotation of the antenna rod in an axial direction and enabling the antenna rod to pivot about a pivot axis with respect to the base.

Preferably, the support comprises a ball mounted at a lower end of the antenna rod, and an elastic supporting member mounted in a groove formed in an upper end of the base for elastically supporting rotation of the ball in any direction. Preferably, the elastic supporting member comprises a rubber material including a spherical socket for holding the ball. Alternatively, the elastic supporting member comprises at least one plate spring fixed to the groove and contacting an outer circumferential surface of the ball.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. Features, elements, and aspects of the invention that are referenced by the same numerals in different figures represent the same, equivalent, or similar features, elements, or aspects in accordance with one or more embodiments.

DETAILED DESCRIPTION OF THE PREFERRED EMBODIMENTS

The present invention is related to a retractable antenna operatively connected to a terminal body and capable of being retractably housed into and withdrawn out of the terminal body. Referring to the accompanying drawings, preferred embodiments of the antenna and of a portable terminal implementing the same in accordance with the present invention will now be described in detail.

Figure 1:
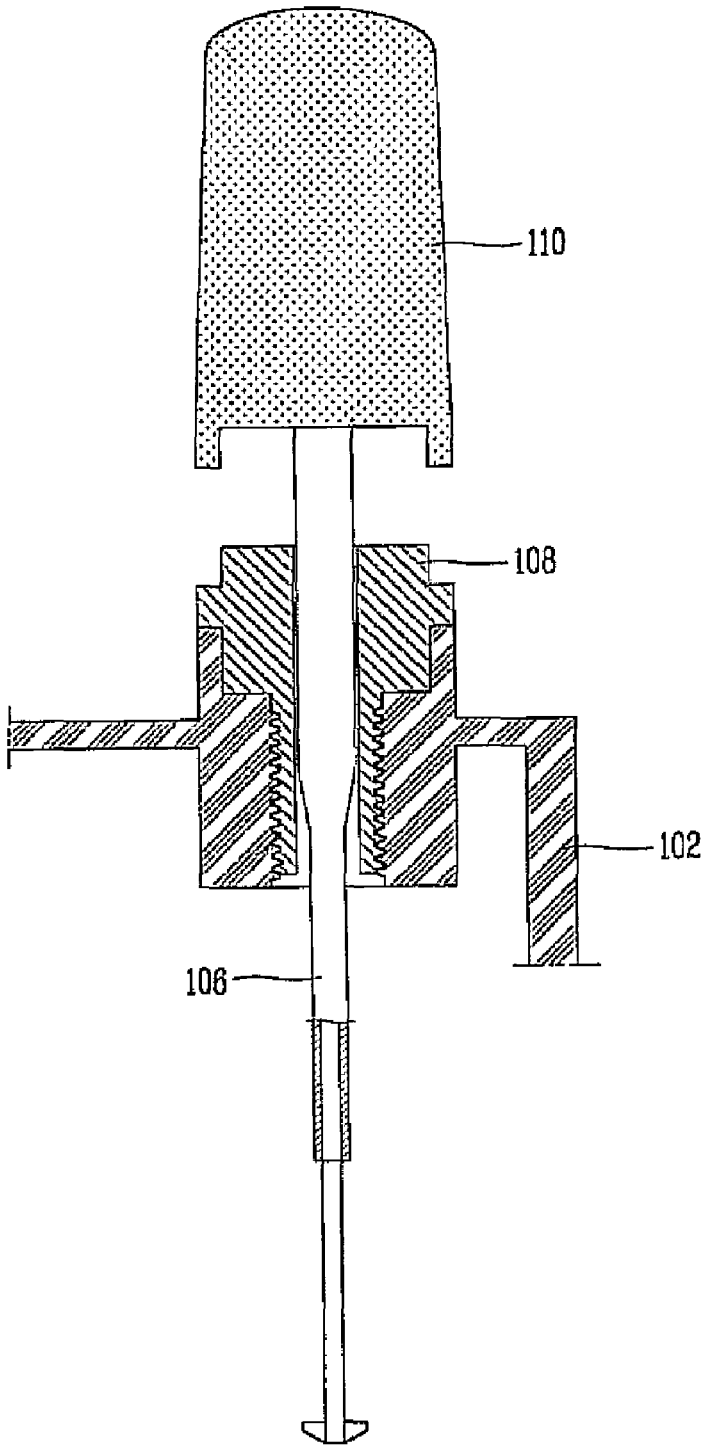
FIG. 1 CONVENTIONAL ART
FIG. 1 is a cross-sectional view of a portable terminal antenna in accordance with the conventional art.
Figure 2:
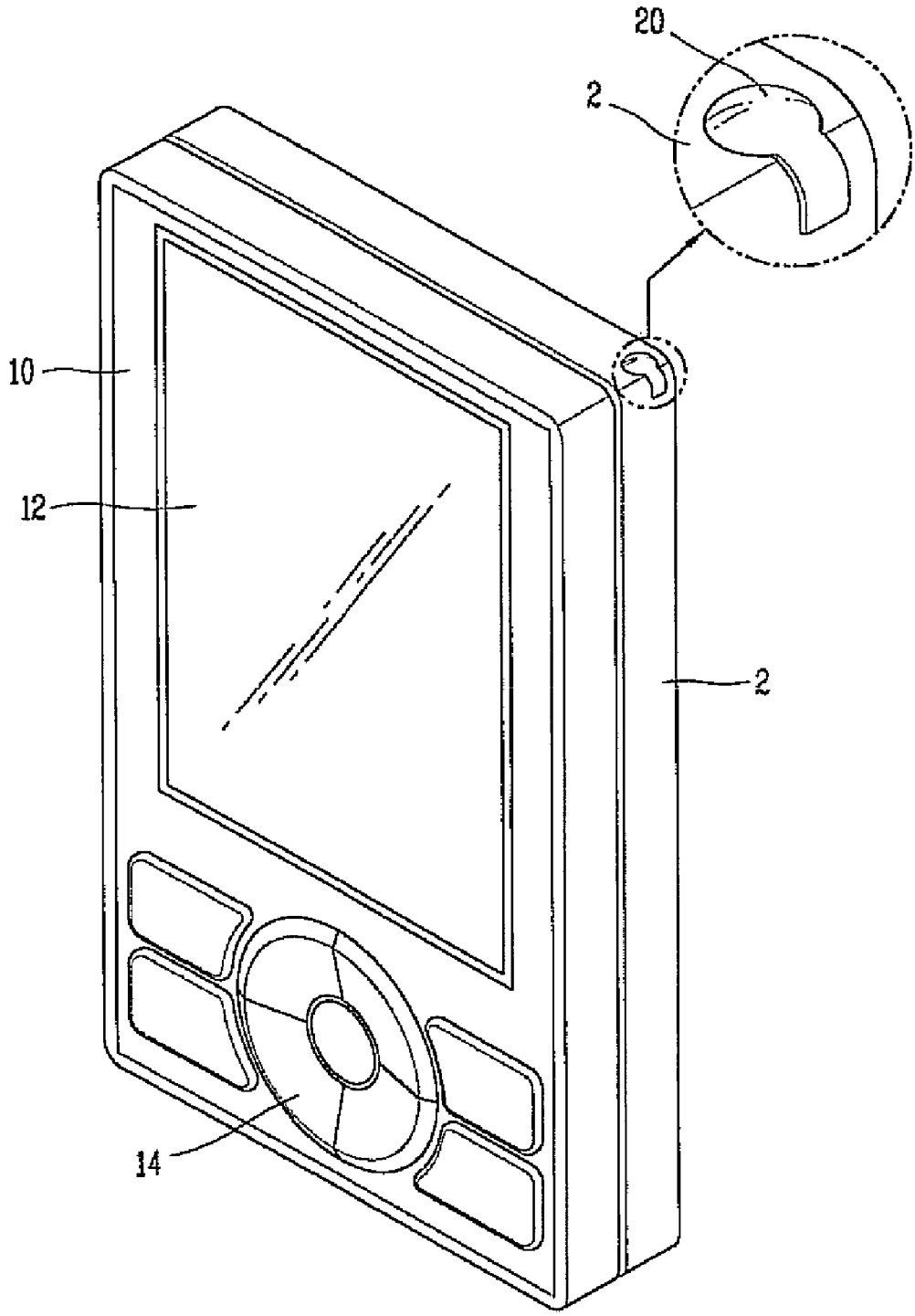
FIG. 2 is a perspective view of a portable terminal implementing an antenna in accordance with a first embodiment of the present invention.
Figure 3:
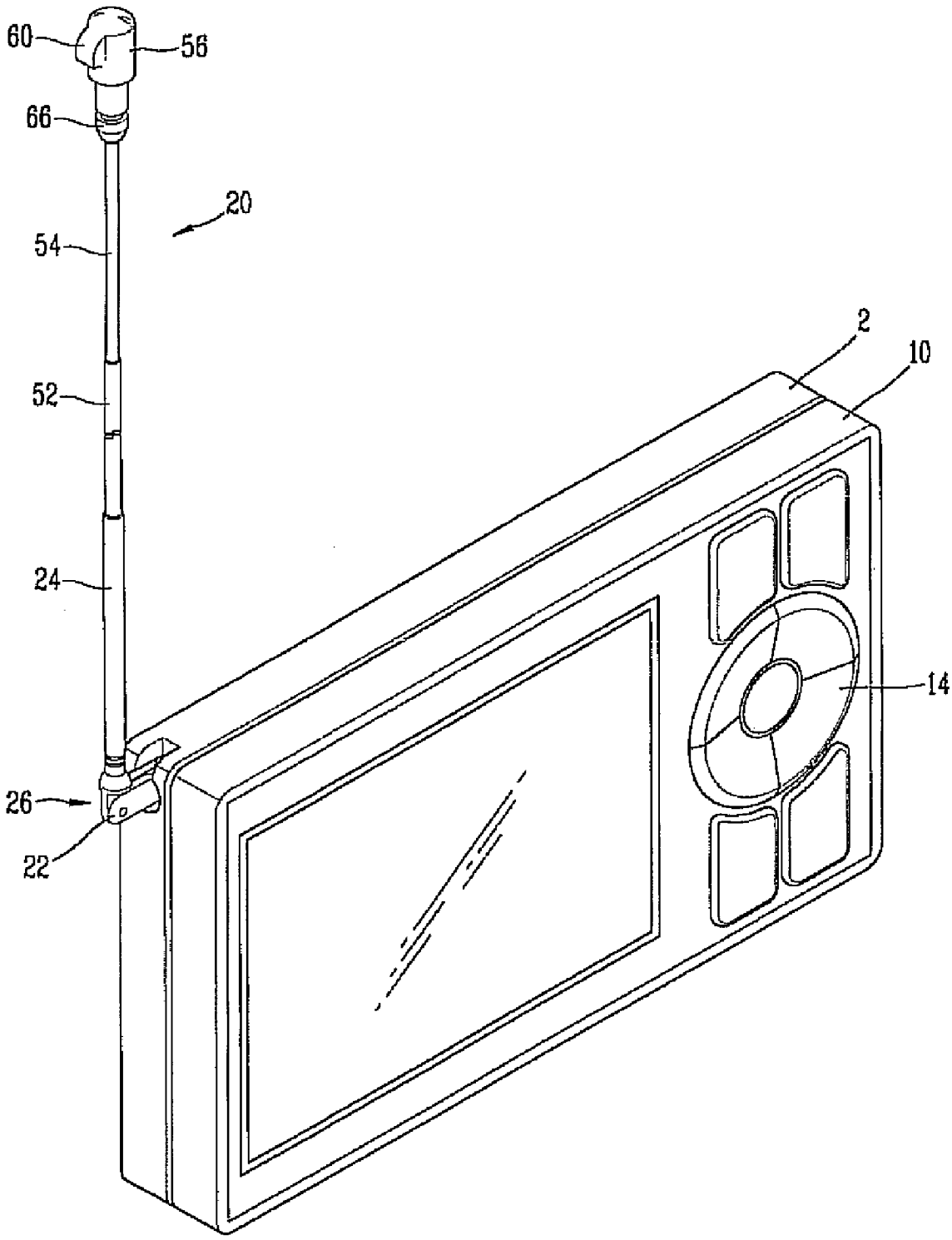
FIG. 3 is a perspective view of a portable terminal in accordance with the first embodiment of the present invention arranged in a landscape or horizontal orientation.
Figure 4:
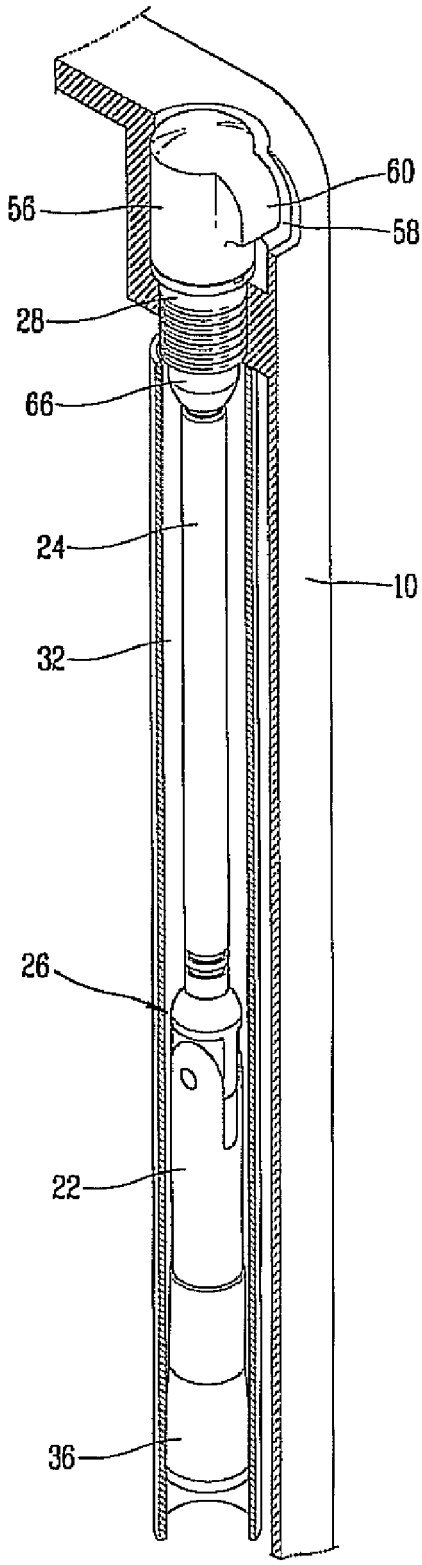
FIG. 4 is a cutaway perspective view illustrating an antenna being stowed in a terminal body in accordance with one embodiment of the present invention.
Figure 5:
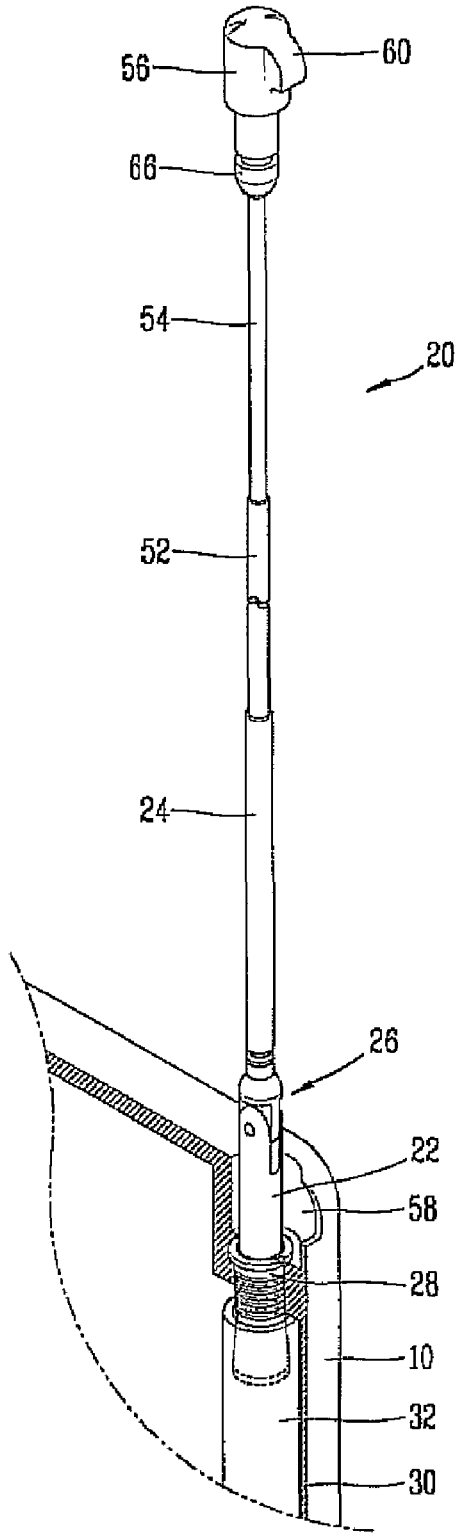
FIG. 5 is a perspective view illustrating an antenna being extended from a terminal body in accordance with one embodiment of the present invention.

FIG. 2 is a perspective view of a portable terminal implementing an antenna in accordance with a first embodiment of the present invention. FIG. 3 is a perspective view of a portable terminal in accordance with the first embodiment of the present invention arranged in a landscape or horizontal orientation. FIG. 4 is a perspective view illustrating an antenna retracted into a terminal body in accordance with one embodiment of the present invention. FIG. 5 is a perspective view illustrating an antenna extended out from a terminal body in accordance with one embodiment of the present invention.

Referring to FIG. 2, the portable terminal to which the antenna in accordance with the present invention is applied includes a display (12) for displaying information, a terminal body (10) to which a keypad (14) for inputting information is mounted, and an antenna (20) retractably mounted in the terminal body (10). Notably, the portable terminal may be any one of various portable terminal types, such as a folder type, a slide type and a swing type portable terminal, for example, as well as a bar type portable terminal as presented in the figures.

Referring to FIG. 3, the antenna (20) includes a base (22) electrically connected to the terminal body (10), and an antenna rod (24) rotatably connected with the base (22) by a pivot connection unit (26). Referring to FIG. 4, in the terminal body (10), a guide tube (32) is installed for preventing the antenna (20) from flexing at the pivot connection unit (26) when the antenna (20) is moved into the terminal body (10).

Preferably, the guide tube (32) is formed of a resin material with a hollow cylindrical shape and mounted in a longitudinal orientation of the terminal body (10). The guide tube (32) linearly guides the antenna when moved in the terminal body (10) so as to prevent the pivot connection unit (26) of the antenna (20) from flexing.

Figure 6:
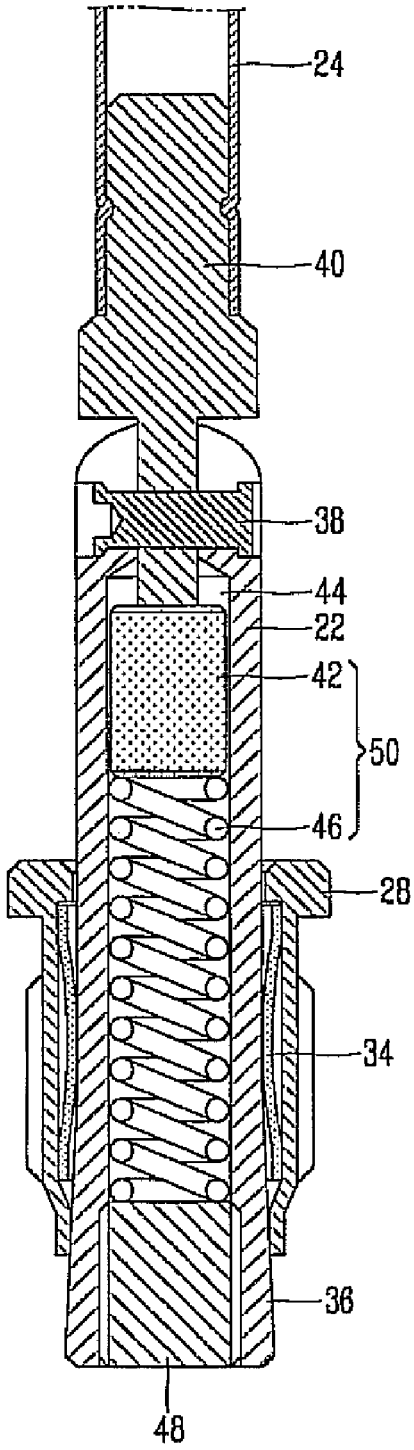
FIG. 6 is a cross-sectional view of a pivot connection unit of an antenna in accordance with one embodiment of the present invention.
Figure 7:
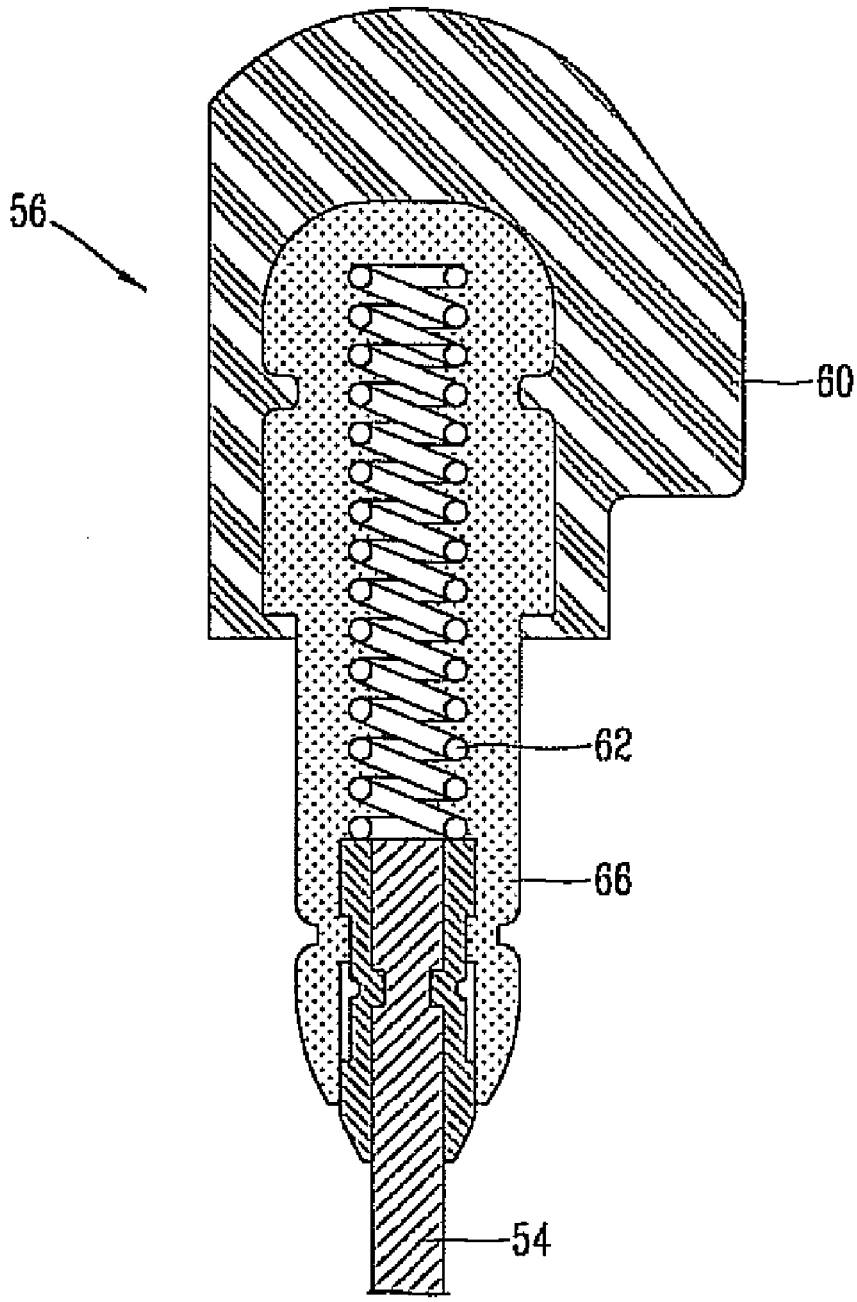
FIG. 7 is a cross-sectional view of an antenna head in accordance with one embodiment of the present invention.

FIG. 6 is a cross-sectional view of a pivot connection unit of an antenna in accordance with one embodiment of the present invention. FIG. 7 is a cross-sectional view of an antenna head in accordance with one embodiment of the present invention.

Referring to FIGS. 4-6, at an upper end of the terminal body (10), the antenna (20) contacts a connection bushing (28) connected to a main printed circuit board mounted in the terminal body (10). Preferably, the connection bushing (28) is formed with a hollow cylindrical shape. At an outer circumferential surface of the connection bushing (28), a threaded portion is formed and coupled to the terminal body (10). At an inner circumferential surface of the connection bushing (28), an elastic member (34) is mounted for supporting a rotated position of the antenna (20), wherein the elastic member (34) is elastically frictional to an outer circumferential surface of a base (22) of the antenna (20). Preferably, the elastic member (34) is formed with a plurality of plate springs at regular intervals contacting the outer circumferential surface of the base (22) as it is installed at the inner circumferential surface of the bushing (28).

A frictional surface (36) is formed at one end of the antenna 20 on the base (22). Preferably, the frictional surface (36) frictionally contacts the inner circumferential surface of the connection bushing (28) in an axial direction for preventing the antenna (20) from being separated from the connection bushing (28). Furthermore, the frictional surface (36) supports an extended state and a rotated position of the antenna (20) in an axial direction.

Preferably, the frictional surface (36) has a flared shape having a wider diameter towards an end of the base (22) to maintain a certain frictional contact even when abraded by friction between the connection bushing (28) and the base (22) after an extended period of use. Specifically, because the frictional surface (36) of the base (22) has an inclined shape, even when abraded by friction with the inner circumferential surface the connection bushing (28), the region contacting the bushing (28) gradually moves lower along the frictional surface (36). Thus, frictional surface contact between the connection bushing (28) and the base (22) can be constantly maintained. Therefore, a supporting force on the antenna (20) can be constantly maintained for maintaining the extended and rotated position of the antenna (20) in the axial direction.

Referring to FIGS. 4-6, the pivot connection unit (26) includes a hinge pin (38) fixed through the base (22) in a direction transverse to a longitudinal axis of the base (22). The pivot connection unit (26) further includes a hinge member (40) rotatably supported by the hinge pin (38) and fixed to a lower end of the antenna rod (24), and an elastic support (50) arranged at the base (22) for elastically supporting the hinge member (24).

Preferably, the hinge member (40) comprises a cylindrical shape at an upper end thereof for being interposed to a lower end of the antenna rod (24). The hinge member (40) further comprises a fiat shape at a lower portion thereof for being rotatably supported by the hinge pin (38). Additionally, the hinge member (40) comprises a semicircular shape at a lower end thereof for supporting the rotated positions of the antenna rod (24) by contacting the elastic support (50).

The elastic support (50) is linearly and movably arranged in a longitudinal bore (44) formed in the base (22), and includes a frictional bearing member (42) contacting the lower end of the hinge member (40) and an elastic member (46) providing an elastic urging force to the frictional bearing member (42). Preferably, the frictional bearing member (42) comprises a rubber material for frictionally engaging the lower end of the hinge member (40) to easily support the rotated position of the antenna rod (40). Preferably, the elastic member (46) comprises a coil spring compressed between a threaded plug (48) coupled to one end of the coil spring at the lower end of the base (22) and a lower surface of the frictional bearing member (42).

In accordance with the present invention, the pivot connection unit (26) enables a user to freely adjust a rotated angle of the antenna rod (24) because the hinge member (40) fixed at the antenna rod (24) is in frictional contact with the frictional bearing member (42). Also, even if the frictional bearing member (42) becomes abraded due to extended use, the frictional force between the frictional bearing member (42) and the hinge member (40) can be constantly maintained because the frictional bearing member (42) is supported by the elastic urging force of the elastic member (46).

Referring to FIG. 5, the antenna rod (24) is formed of a tubular conductor having a hollow interior. Preferably, one or more telescoping inner members (52, 54) for extending the length of the antenna are mounted in the hollow interior of the tubular conductor.

An antenna head (56) is fixed at an upper end of an uppermost inner member (54). Referring to FIGS. 4 and 5, a head insertion opening (58) is recessed into an upper surface of the terminal body (10). Preferably, the antenna head (56) is inserted into the head insertion opening (58) so that the antenna (20) is completely received within the terminal body (10) without any protruded portion. Thus, the terminal body (10) is formed with a streamlined structure without any unsightly antenna components protruding from the terminal body (10). In addition, a knob (60) is formed at the antenna head (56). The knob (60) may be grasped by a user and pulled upon so as to extract the antenna (20) from the head insertion opening (58).

Preferably, a helical antenna connected to the inner member (54) is mounted in the antenna head (58). In addition, a stopping jaw (66) is formed at the antenna head (56) for preventing the antenna (20) from being ejected from the terminal body (10) while the antenna (20) is received within the terminal body (10).

Preferably, the stopping jaw (66) protrudes in a band shape in a circumferential direction at a lower portion of the antenna head (56). Thus, as the antenna (20) is received within the terminal body (10), the stopping jaw (66) is stopped by the inner circumferential surface of the bushing (28) for preventing the antenna (20) from being inadvertently withdrawn. Accordingly, because the stopping jaw (66) is formed at the antenna head (56), if a user pulls upon the knob (60) of the antenna head (56), the base (22) and the antenna rod (24) of the antenna (20) are extracted outside of the terminal body (10). The telescoping inner members (52, 54) mounted in the antenna rod (24) may be sequentially extended thereafter. Therefore, the antenna (20) may assume an overall length suitable for receiving a satellite broadcast or digital broadcast service.

An operation of the antenna in accordance with the present invention as configured above will now be described. In a received state, wherein the antenna is fully within the terminal (10), the antenna (20) is inserted into the guide tube (32) mounted in the terminal body (10) and the plurality of inner members (52, 54) are nested inside the antenna rod (24).

The antenna head (56) is inserted fully into the head insertion opening (58) formed in the upper surface of the terminal body (10) without any protruded portion. Moreover, the stopping jaw (66) formed at the antenna head (56) is stopped by the inner circumferential surface of the bushing (28) so as to prevent the antenna (20) from being freely ejected from the terminal body (10).

Preferably, when the antenna (20) is extended from the terminal body (10) to satisfy a DMB reception band frequency wavelength requirement, a user pulls upon the knob (60) formed at the antenna head (56). Thereafter, the stopping jaw (66) formed at the antenna head (56) is separated from the bushing (28) and freed. Accordingly, the base (22) and the antenna rod (24) of the antenna (20) are integrally extracted from the terminal body (10). That is, because the stopping jaw (66) is formed at the antenna head (58), once the stopping jaw (66) is unlocked, first the base (22) and the antenna rod (24) are extracted from the terminal body (10), and if the antenna head (56) is pulled further, then the plurality of telescoping inner members (52, 54) mounted in the antenna rod (24) are sequentially extracted.

Furthermore, the frictional surface (36) of the base (22) frictionally engages the inner circumferential surface of the bushing (28) to maintain the extended state of the antenna (20) and support the rotated location of the antenna (20) in the axial direction. As the antenna (20) is extended, the terminal body (10) may be arranged in a landscape or horizontal orientation. Accordingly, the antenna rod (24) may be rotated centering around the pivot connection unit (26) and arranged in a desired position. The pivot connection unit (26) supports the rotated position of the antenna rod (24) as the hinge member (40) fixed at the antenna rod (24) is elastically supported by the elastic support (50) arranged in the base (22).

Figure 8:
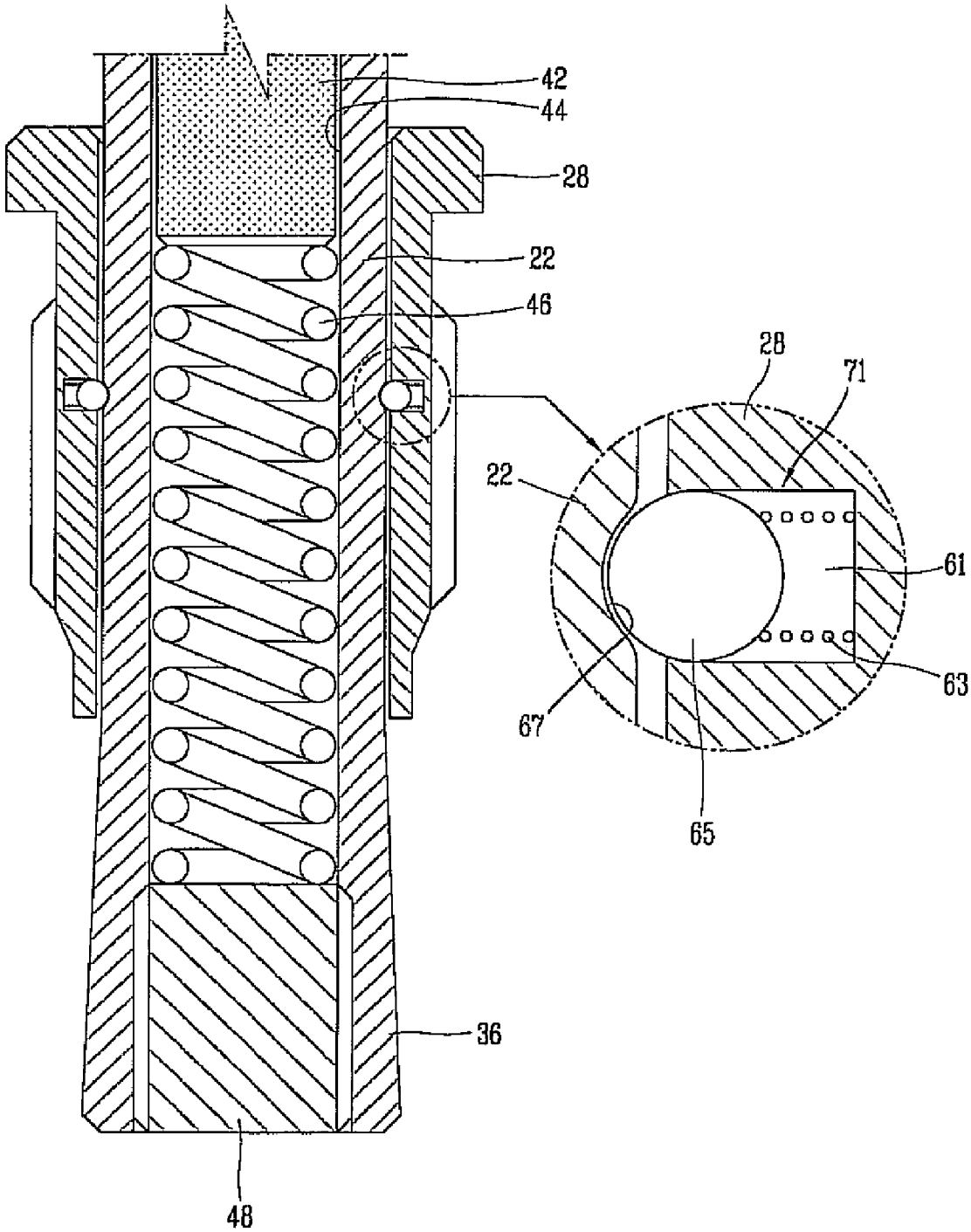
FIG. 8 is a partial cross-sectional view of an antenna in accordance with a second embodiment of the present invention.

FIG. 8 is a cross-sectional view of an antenna in accordance with a second embodiment of the present invention. The antenna in accordance with the second embodiment has the same configuration as the antenna described in the first embodiment, and additionally, has a configuration providing a multitude of rotated position stops when the antenna is rotated in the extended state.

Referring to FIG. 8, in accordance with the second embodiment of the present invention, the antenna (20) comprises a multi-stop support (71) mounted between an inner surface of the bushing (28) and an outer surface of the base (22) for supporting multiple rotated positions of the antenna when the antenna is rotated. The multi-stop support (71) includes at least one recess (61) extending axially perpendicular in an inner circumferential surface of the bushing (28), a supporting ball (65) movable within the at least one recess (61), and a plurality of semispherical detents (67) formed at regular angular intervals in the outer circumferential surface of the base (22) into which the supporting ball (65) may be inserted. An elastic member (63) exerting an elastic urging force upon the supporting ball (65) is installed in the recess (61). Notably, any structure capable of supporting the rotated position of the antenna with multiple-stops as well as the structure described above can be applied for the multi-stop support (71).

In accordance with the second embodiment of the present invention, when the antenna is extended, the base (22) is located opposite to the inner surface of the bushing (28). Then, if the antenna is rotated, the supporting ball (65) elastically supported by the elastic member (63) is inserted into one of the plurality of detents (67) to support the rotated current position of the antenna.

Figure 9:
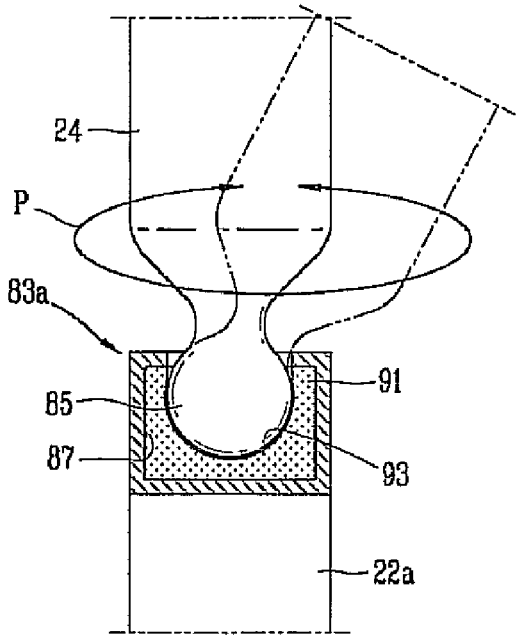
FIG. 9 is a cross-sectional view of a pivot connection unit of an antenna in accordance with a third embodiment of the present invention.

FIG. 9 is a cross-sectional view of a pivot mechanism of an antenna in accordance with a third embodiment of the present invention. Referring to FIG. 9, the antenna in accordance with the third embodiment is supported for axial rotation and has a supporting unit (83*a*) for maintaining the pivoted position of the antenna.

That is, the antenna in accordance with the third embodiment is pivotably supported by a supporting unit (83*a*) which maintains a rotated position of the antenna. Preferably, the antenna includes an antenna rod (24), a base (22*a*), and the supporting unit (83*a*) arranged between the antenna rod (24) and the base (22*a*).

Preferably, the antenna rod (24) has the same structure as that described in the first embodiment. The base (22*a*) is prevented from being abraded by friction of the bushing (28) since it is supported not to be rotated inside the bushing (28) into which the base (22*a*) is inserted.

The supporting unit (83*a*) includes a ball (85) mounted at a lower end of the antenna rod (24) and an elastic supporting member (91) mounted in a groove formed at an upper end of the base (22*a*) for elastically supporting the ball (85) to be freely rotated in any direction. Preferably, the elastic supporting member (91) comprises a conductive rubber or other elastomeric material having a semi-spherical socket opening (93) formed therein for holding the ball (85). Notably, any type of elastic supporting member having a suitable shape, such as a plate spring capable of rotatably and elastically supporting the ball (85), can be used as the elastic supporting member (91).

In accordance with the third embodiment of the present invention, after the antenna is withdrawn from the terminal body, the antenna's axis may be rotated in a direction shown by the arrow P. Accordingly, the antenna is rotatably supported at a ball end while the antenna is rotated. Because the ball (85) is elastically supported by the elastic supporting member (91), the antenna can maintain the rotated position. That is, when the antenna is rotated to adjust the angle of the antenna, the ball end, elastically supported by the elastic supporting member (91), maintains the rotated position of the antenna.

Figure 10:
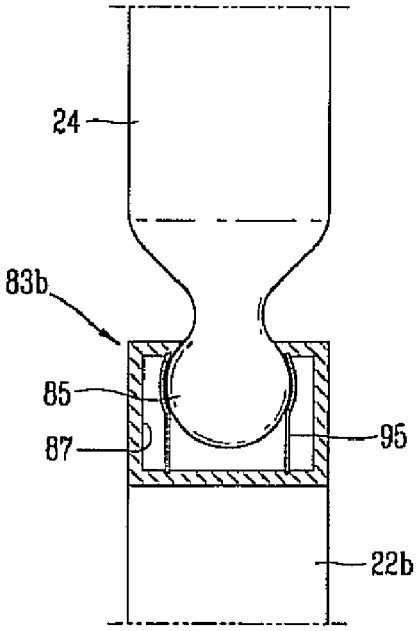
FIG. 10 is a cross-sectional view of a pivot connection unit of an antenna in accordance with a fourth embodiment of the present invention.

FIG. 10 is a cross-sectional view of a pivot connection unit of an antenna in accordance with a fourth embodiment of the present invention. Referring to FIG. 10, the antenna in accordance with the fourth embodiment is supported for axial rotation and has a supporting unit (83*b*) for maintaining the pivoted position of the antenna. The supporting unit (83*b*) has the same structure as that described in the supporting unit (83*a*) of the third embodiment except that the elastic supporting member (95) is different from the elastic supporting member (91) of the third embodiment. That is, the elastic supporting member (95) is formed to have a plate-spring type for elastically supporting the ball (85).

Figure 11:
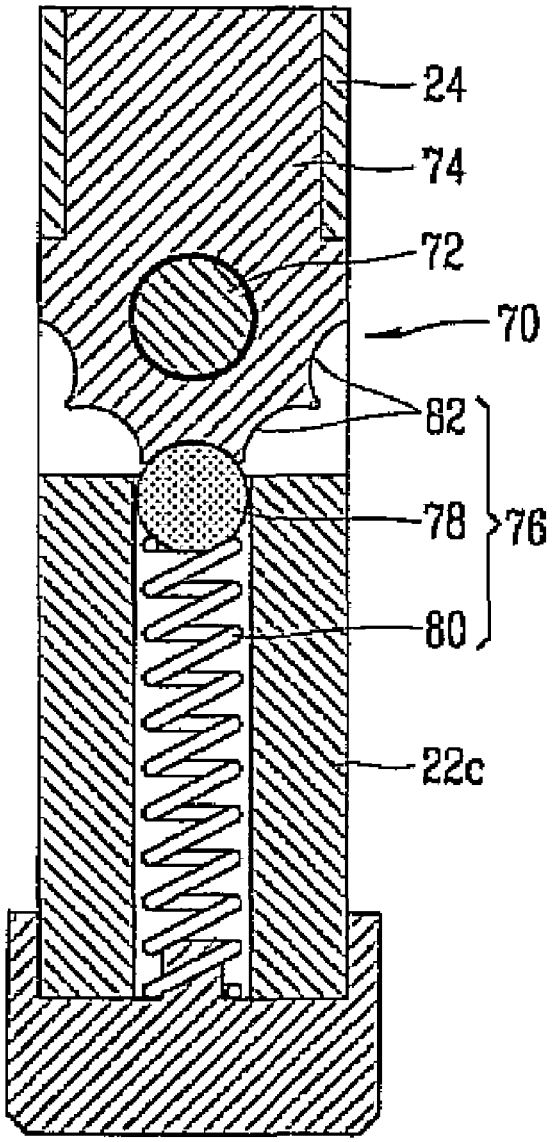
FIG. 11 is a cross-sectional view of a pivot connection unit of an antenna in accordance with a fifth embodiment of the present invention.

FIG. 11 is a cross-sectional view of a pivot connection unit of an antenna in accordance with a fifth embodiment of the present invention. Referring to FIG. 11, a pivot connection unit (70) enables pivoting of the antenna rod (24) with multiple stops. The pivot connection unit (70) includes a hinge member (74) fixed to a lower end of the antenna rod (24) and rotatable on a hinge pin (72) fixed to a base (22*c*), and a multi-stop support (76) installed between the hinge member (74) and the base (22*c*) supporting the hinge member (74) to be pivotable with multiple position stops.

The multi-stop support (76) includes a plurality of semicircular detent grooves (82) formed at regular angular intervals incised around a semicircular lower end surface of the hinge member (74), a supporting ball (78) elastically supported by the base (22) and insertable into the detent grooves (82), and an elastic member (80) providing an elastic urging force upon the ball (78) and arranged in the base (22*c*). The hinge member (74) is rotatable centering around the hinge pin (72) by the pivot connection unit (70). After a stopping angle is adjusted in the withdrawn state of the antenna rod (24), the ball (78) is stopped in one of the plurality of detent grooves (82) formed at the hinge member (74). Thus, the rotated position of the antenna rod (24) with the multiple position stops is supported.

Figure 12:
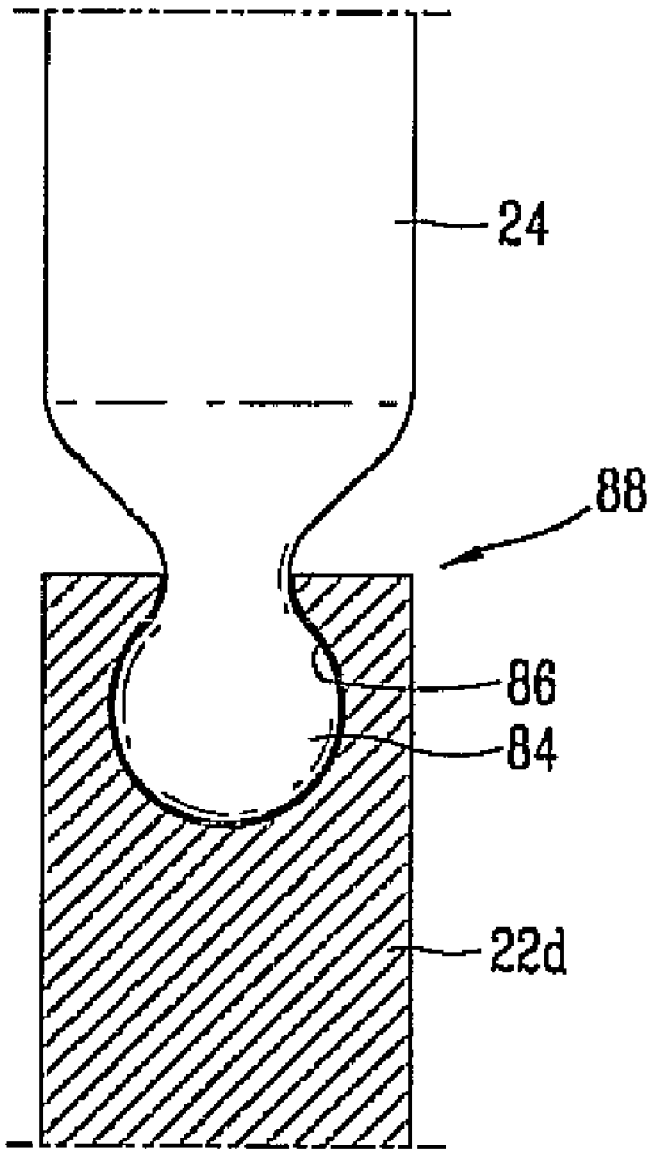
FIG. 12 is a cross-sectional view of a pivot connection unit of an antenna in accordance with a sixth embodiment of the present invention.

FIG. 12 is a cross-sectional view of a pivot connection unit of an antenna in accordance with a sixth embodiment of the present invention. Referring to FIG. 12, the pivot connection unit in accordance with the sixth embodiment comprises a ball-and-socket type hinge. Preferably, the pivot connection unit (88) includes a ball (84) connected to a lower end of the antenna rod (24), and a spherical socket unit (86) formed in an upper end of the base (22*d*). Preferably, the ball (84) is inserted into the socket unit (86) to rotatably support the ball (84).

In accordance with the present invention, the pivot connection unit (88) is rotatable when the ball (84), connected with the antenna rod (24), is inserted in the spherical groove unit (86) for supporting the rotated position of the antenna rod (24). Accordingly, the pivot connection unit (88) enables the antenna rod (24) to freely rotate in any direction.

Figure 13:
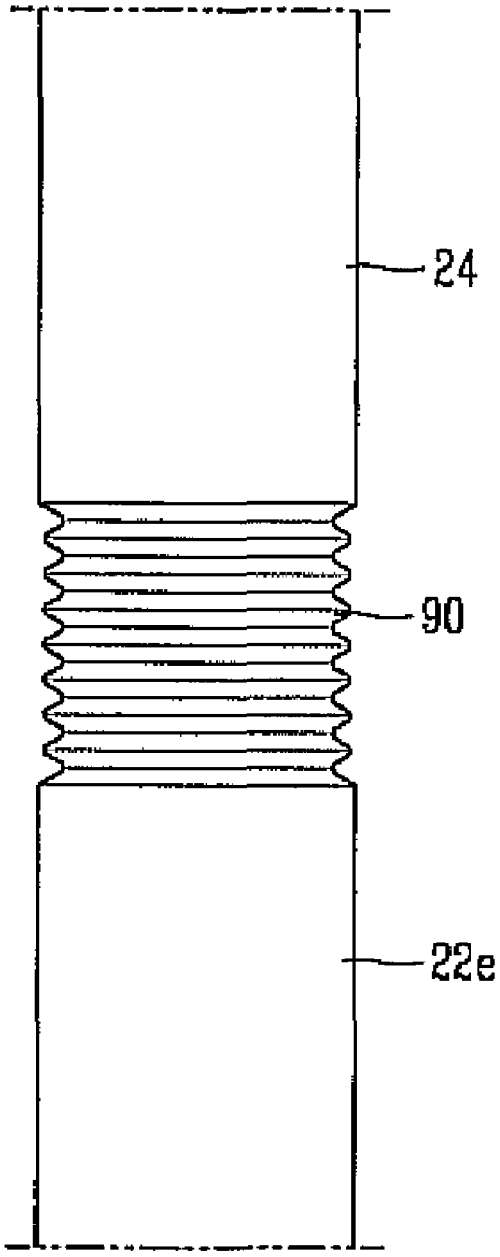
FIG. 13 is a cross-sectional view of a pivot connection unit of an antenna in accordance with a seventh embodiment of the present invention.

FIG. 13 is a cross-sectional view of a pivot connection unit of an antenna in accordance with a seventh embodiment of the present invention. Referring to FIG. 13, the pivot connection in accordance with the seventh embodiment comprises flexible connection bellows (90) connected between a lower end of the antenna rod (24) and an upper end of the base (22*e*). Preferably, the connection bellows (90) have a corrugated shape and flexibly supports the rotated position of the antenna rod (24).

In accordance with the present invention, a retractable antenna is mounted at the terminal body, and the base (22*e*) and the antenna rod (24) are connected with each other to be relatively rotatable by means of the pivot connection unit. Accordingly, the antenna rod (24) is freely rotated in any direction for convenient use.

Preferably, the antenna rod is rotatably connected by means of the pivot connection unit such that the rotated angle of the antenna rod can be freely adjusted. Further, a hinge member of the pivot connection unit is elastically supported by an elastic support such that loosening of a rotating portion of the antenna after frequent use may be prevented.

As the present invention may be embodied in several forms without departing from the spirit or essential characteristics thereof it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. A portable terminal comprising:

a terminal body; and a retractable antenna operatively connected to the terminal body and capable of being retractably housed into and withdrawn out of the terminal body, wherein the retractable antenna comprises:

a base rotatably supported at the terminal body;

an antenna rod connected with the base and including at least one telescoping member for extending a length of the antenna rod; and a pivot connection unit connecting the base to the antenna rod and allowing the antenna rod to pivot with respect to the base, wherein an elastic member is provided in the terminal body to elastically contact an outer circumferential surface of the base.

2. The portable terminal of claim 1, further comprising a connection bushing mounted at the terminal body for guiding a linear motion of the retractable antenna and electrically connecting the antenna to the terminal body.

3. The portable terminal of claim 2, wherein the outer circumferential surface of the base frictionally engages an inner circumferential surface of the connection bushing to support a rotated position of the antenna rod.

4. The portable terminal of claim 3, wherein the elastic member is provided at the inner circumferential surface of the connection bushing.

5. The portable terminal of claim 4, wherein the elastic member comprises one or more plate springs.

6. The portable terminal of claim 3, wherein the outer circumferential surface of the base comprises a flared shape having a wider diameter towards a lower end thereof.

7. The portable terminal of claim 2, further comprising a multi-stop support formed between the base and the connection bushing for supporting a rotated position of the antenna rod.

8. The portable terminal of claim 7, wherein the multi-stop support comprises:

at least one ball elastically supported at an inner circumferential surface of the connection bushing; and a plurality of detent recesses formed at an outer circumferential surface of the base at angular intervals for engagement by the at least one ball.

9. The portable terminal of claim 1, further comprising a head formed at an upper end of an uppermost telescoping member, wherein the head inserts into the terminal body when the retractable antenna is retractably housed into the terminal body.

10. The portable terminal of claim 9, further comprising a knob formed at the head, wherein the knob is capable of being grasped and pulled by a user to withdraw the retractable antenna from the terminal body.

11. The portable terminal of claim 9, further comprising a stopping jaw formed at the head, wherein the stopping jaw prevents the retractable antenna from being ejected from the terminal body while the retractable antenna is housed within the terminal body.

12. The portable terminal of claim 1, further comprising a guide tube formed in the terminal body and extending in a longitudinal direction thereof for linearly guiding the antenna into and out of the terminal body.

13. The portable terminal of claim 1, wherein the pivot connection unit comprises:

a hinge member fixed to a lower end of the antenna rod and rotatably supported by a hinge shaft mounted at the base; and an elastic support installed in the base for elastically supporting the hinge member to maintain a rotated position of the antenna rod.

14. The portable terminal of claim 13, wherein the elastic support comprises:

a linearly movable frictional member arranged within a space formed in the base and contacting a lower end of the hinge member; and an elastic member arranged within the space in the base and providing an elastic urging force to the frictional member.

15. The portable terminal of claim 14, wherein the frictional member comprises a rubber material providing a frictional engaging force to the hinge member.

16. The portable terminal of claim 1, wherein the pivot connection unit comprises:

a hinge member fixed to a lower end of the antenna rod and rotatably supported by a hinge pin fixed to the base; and a multi-stop support provided between the base and the hinge member for supporting rotation of the hinge member in multiple stages.

17. The portable terminal of claim 16, wherein the multi-stop support comprises:

a plurality of indentations formed in a circumferential direction at a lower end of the hinge member at regular angular intervals;

a ball elastically arranged at the base for engaging the plurality of indentations; and an elastic member for providing an elastic urging force to the ball.

18. The portable terminal of claim 16, wherein the pivot connection unit comprises a ball-and-socket type hinge.

19. The portable terminal of claim 16, wherein the pivot connection unit comprises a bellows shape.

20. A portable terminal having an antenna comprising:

a terminal body; and a retractable antenna operatively connected to the terminal body and capable of being retractably housed into and withdrawn out of the terminal body, wherein the retractable antenna comprises:

a base rotatably supported at the terminal body;

an antenna rod connected with the base and including at least one telescoping member for extending a length of the antenna rod; and a support provided between the base and the antenna rod for supporting rotation of the antenna rod in an axial direction and enabling the antenna rod to pivot about a pivot axis with respect to the base, wherein an elastic member is provided in the terminal body to elastically contact an outer circumferential surface of the base.

21. The portable terminal of claim 20, wherein the support comprises:

a ball mounted at a lower end of the antenna rod; and an elastic supporting member mounted in a recess formed in an upper end of the base for elastically supporting rotation of the ball in any direction.

22. The portable terminal of claim 21, wherein the elastic supporting member comprises a rubber material including a spherical socket for holding the ball.

23. The portable terminal of claim 21, wherein the elastic supporting member comprises at least one plate spring fixed to the recess and contacting an outer circumferential surface of the ball.

24. An antenna for an electronic device, the antenna comprising:

a base operatively connected to and rotatably supported at a body of the electronic device, the base capable of being retractably housed into and withdrawn out of the body;

an antenna rod connected with the base and including at least one telescoping member for extending a length of the antenna rod, the antenna rod capable of being retractably housed into and withdrawn out of the body; and a pivot connection unit connecting the base to the antenna rod and allowing the antenna rod to pivot with respect to the base, wherein an elastic member is provided in the body to elastically contact an outer circumferential surface of the base.

25. The antenna of claim 24, wherein a connection bushing is mounted at the body for guiding a linear motion of the antenna and electrically connecting the antenna to the body.

26. The antenna of claim 25, wherein an outer circumferential surface of the base frictionally engages an inner circumferential surface of the connection bushing to support a rotated position of the antenna rod.

27. The antenna of claim 26, wherein the elastic member is provided at the inner circumferential surface of the connection bushing.

28. The antenna of claim 26, wherein the outer circumferential surface of the base comprises a flared shape having a wider diameter towards a lower end thereof.

29. The antenna of claim 25, further comprising a multi-stop support formed between the base and the connection bushing for supporting a rotated position of the antenna rod.

30. The antenna of claim 29, wherein the multi-stop support comprises:

at least one ball elastically supported at an inner circumferential surface of the connection bushing; and a plurality of indentations formed at an outer circumferential surface of the base at angular intervals for engagement by the at least one ball.

31. The antenna of claim 24, further comprising:

a head formed at an upper end of an uppermost telescoping member, the head capable of being retractably housed into and withdrawn out of the body; and a stopping jaw formed at the head, wherein the stopping jaw prevents the head from being ejected from the body while the head is housed within the body.

32. The antenna of claim 24, wherein the pivot connection unit comprises:

a hinge member fixed to a lower end of the antenna rod and rotatably supported by a hinge shaft mounted at the base; and an elastic support installed in the base for elastically supporting the hinge member to maintain a rotated position of the antenna rod.

33. The antenna of claim 32, wherein the elastic support comprises:

a linearly movable frictional member arranged within a space formed in the base and contacting a lower end of the hinge member; and an elastic member arranged within the space in the base and providing an elastic urging force to the frictional member.

34. The antenna of claim 33, wherein the frictional member comprises a rubber material providing a frictional engaging force to the hinge member.

35. The antenna of claim 24, wherein the pivot connection unit comprises:

a hinge member fixed to a lower end of the antenna rod and rotatably supported by a hinge pin fixed to the base; and a multi-stop support provided between the base and the hinge member for supporting rotation of the hinge member in multiple position stops.

36. The antenna of claim 35, wherein the multi-stop support comprises:

a plurality of recesses formed in a circumferential direction at a lower end of the hinge member at angular intervals;

a ball elastically arranged at the base for engaging the plurality of recesses; and an elastic member for providing an elastic urging force to the ball.

37. The antenna of claim 24, wherein the pivot connection unit comprises a ball-and-socket type hinge.

38. The antenna of claim 24, wherein the pivot connection unit comprises a bellows shape.

39. An antenna for an electronic device, the antenna comprising:

a base operatively connected to and rotatably supported at a body of the electronic device, the base capable of being retractably housed into and withdrawn out of the body;

an antenna rod connected with the base and including at least one telescoping member for extending a length of the antenna rod, the antenna rod capable of being retractably housed into and withdrawn out of the body; and a support provided between the base and the antenna rod for supporting rotation of the antenna rod in an axial direction and enabling the antenna rod to pivot about a pivot axis with respect to the base, wherein an elastic member is provided in the body to elastically contact an outer circumferential surface of the base.

40. The antenna of claim 39, wherein the support comprises:

a ball mounted at a lower end of the antenna rod; and an elastic supporting member mounted in a groove formed in an upper end of the base for elastically supporting rotation of the ball in any direction.

41. The antenna of claim 40, wherein the elastic supporting member comprises a rubber material including a spherical socket for holding the ball.

42. The antenna of claim 40, wherein the elastic supporting member comprises at least one plate spring fixed to the groove and contacting an outer circumferential surface of the ball.

* * * * *